US006793483B2

(12) United States Patent
Watanabe

(10) Patent No.: US 6,793,483 B2
(45) Date of Patent: Sep. 21, 2004

(54) COMBUSTION BURNER

(76) Inventor: Masahiro Watanabe, 3-15-12 Narimasu, Itabashi-ku, Tokyo (JP)

( * ) Notice: Subject to any disclaimer, the term of this patent is extended or adjusted under 35 U.S.C. 154(b) by 0 days.

(21) Appl. No.: 10/375,212

(22) Filed: Feb. 26, 2003

(65) Prior Publication Data

US 2004/0166451 A1 Aug. 26, 2004

(51) Int. Cl.[7] ..... F24C 1/14

(52) U.S. Cl. ..... 431/4; 431/158; 431/187; 431/284; 431/354

(58) Field of Search ..... 431/1, 4, 10, 187, 431/188, 354, 158, 352, 90, 12, 284, 62; 110/262; 261/18.2

(56) References Cited

U.S. PATENT DOCUMENTS

| | | | | | |
|---|---|---|---|---|---|
| 4,403,944 A | * | 9/1983 | Pyykkonen | ..... | 431/90 |
| 4,425,854 A | * | 1/1984 | Calfo et al. | ..... | 110/262 |
| 4,443,183 A | * | 4/1984 | Shimizu et al. | ..... | 431/354 |
| 4,519,769 A | * | 5/1985 | Tanaka | ..... | 431/4 |
| 6,595,769 B2 | * | 7/2003 | Watanabe | ..... | 431/4 |

* cited by examiner

*Primary Examiner*—James C. Yeung
(74) *Attorney, Agent, or Firm*—Jordan and Hamburg LLP

(57) ABSTRACT

A combustion burner includes an air supply case connected to an air supply mouth a position at a position on the air supply case from a rear end part to a tip portion thereof, which supplies air from air supply equipment; a nozzle body attached so as to cover a tip portion of the air supply case, and having a jet nozzle formed in a center part of the nozzle body; a fuel nozzle in the nozzle body so as to supply air from the air supply case through an air jet hole, placed between the tip perimeter part of the fuel nozzle and the jet nozzle, having a frusto-conically shaped fuel supply passage, and which supplies air from a tip portion thereof; a plurality of air guide holes provided between an outer circumferential portion of the fuel nozzle and the nozzle body so as to supply air from the air jet hole in a spiral pattern; a fuel supply support member in the fuel supply passage, which supplies fuel from at least two fuel supply holes in an opposite spiral pattern from the tip end of the fuel nozzle; and at least two fuel supply pipes, one end part of the fuel supply pipes being connected to the fuel supply holes, another end part thereof being connected to a fuel supply which supplies waste oil, heavy oil and the like; and a water supply, which supplies water, dirty water and the like. Water, air, and oil, including waste oil, heavy oil and the like are mixed as an emulsion at a top part of a nozzle and mixed fuel is burned at lower cost without dissociation of the emulsion. The combustion burner of the invention obviates the need for expensive equipment, including a mixer, heretofore conventionally required, and can be used independently of such mixing equipment.

17 Claims, 25 Drawing Sheets

COMBUSTION BURNER

BACKGROUND OF THE INVENTION

The present invention relates to a combustion burner which burns fuel including waste oil and heavy oil.

When burning heavy oil, especially grade C heavy oil and other similar oil, conventionally, water and emulsifier are added to the C heavy oil and a churning mixing operation is performed by using an expensive churning mixer/to produce an emulsified fuel mixture, which is supplied into a combustion burner by using a fuel supply pipe, and burned.

Since C heavy oil and water are mixed using an emulsifier, the conventional combustion method involves high cost. Also, an expensive churning mixing operation is because heavy oil, especially C heavy oil, cannot be used alone as fuel in the conventional combustion method.

Moreover, since the mixture is supplied from the churning mixer to the combustion burner using the fuel supply pipe, the emulsified mixture of C heavy oil and water dissociates while being supplied, and the combustion becomes inefficient.

SUMMARY OF THE INVENTION

In light of the forgoing, it is an object of the present invention to provide a combustion burner in which water, air, and oil including waste oil, heavy oil and the like are mixed at a top part of a nozzle feeding the combustion burner and the resulting mixed fuel is burned in combustion burner at lower cost, without dissociation of the mixed fuel occurring.

It is another object of the present invention to provide a combustion burner which obviates the need for the expensive equipment including a mixer heretofore conventionally required and which can be used without the need for emulsification.

Novel features which are believed to be characteristic of the invention, both as to its configuration and method of operation, together with further objects and advantages thereof, are described below with reference to the accompanying drawings in which preferred embodiments of the invention are illustrated as an example.

It is to be expressly understood, however, that the drawings are for the purpose of illustration and description only, and are not intended as a definition of the limits of the invention.

BRIEF DESCRIPTION OF THE DRAWINGS

Preferred embodiments of the present invention are described in more detail below referring to the accompanying drawings, wherein.

DETAILED DESCRIPTION OF THE PREFERRED EMBODIMENTS

Figure 1:
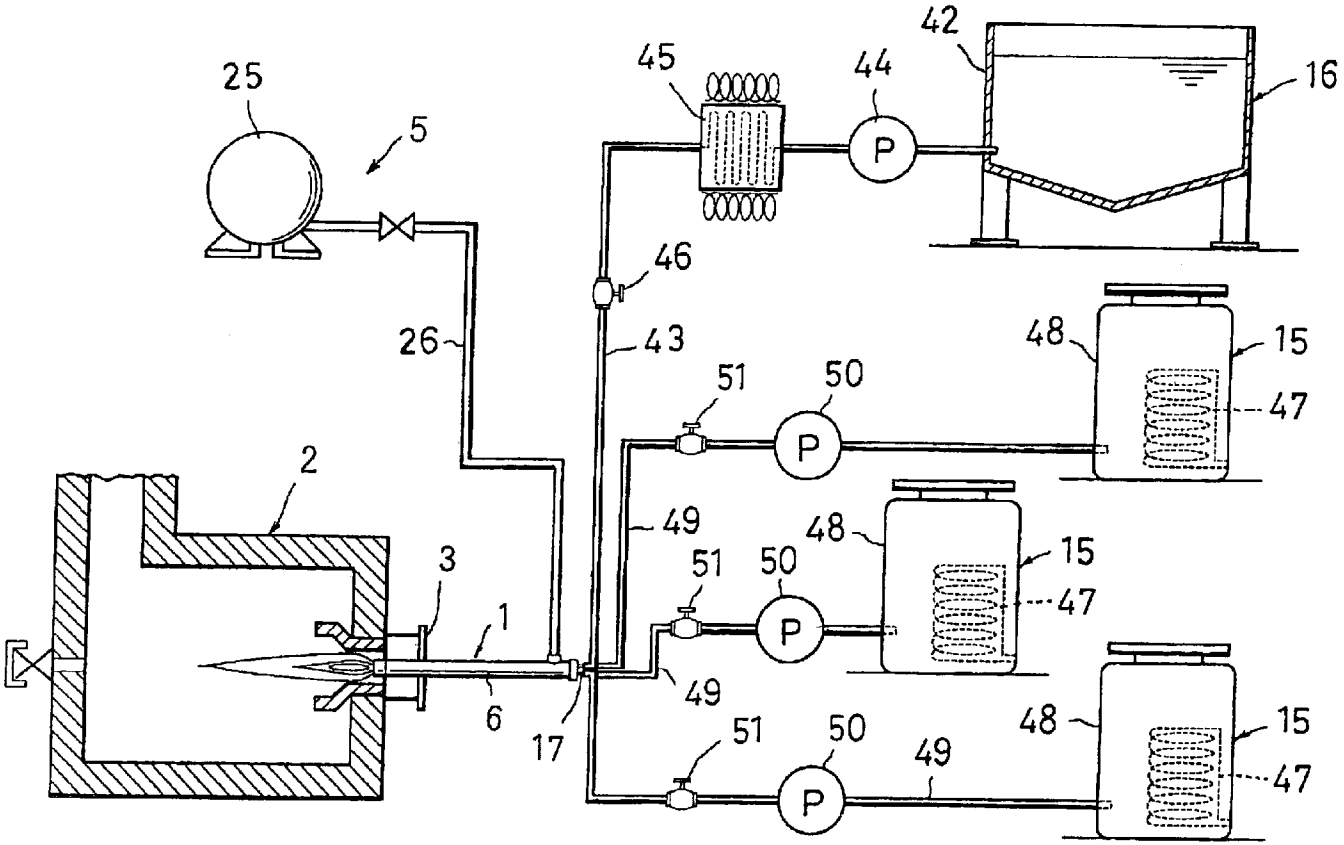
FIG. 1 is an overall view of a first embodiment of a combustion burner and system according to the present invention.
Figure 2:
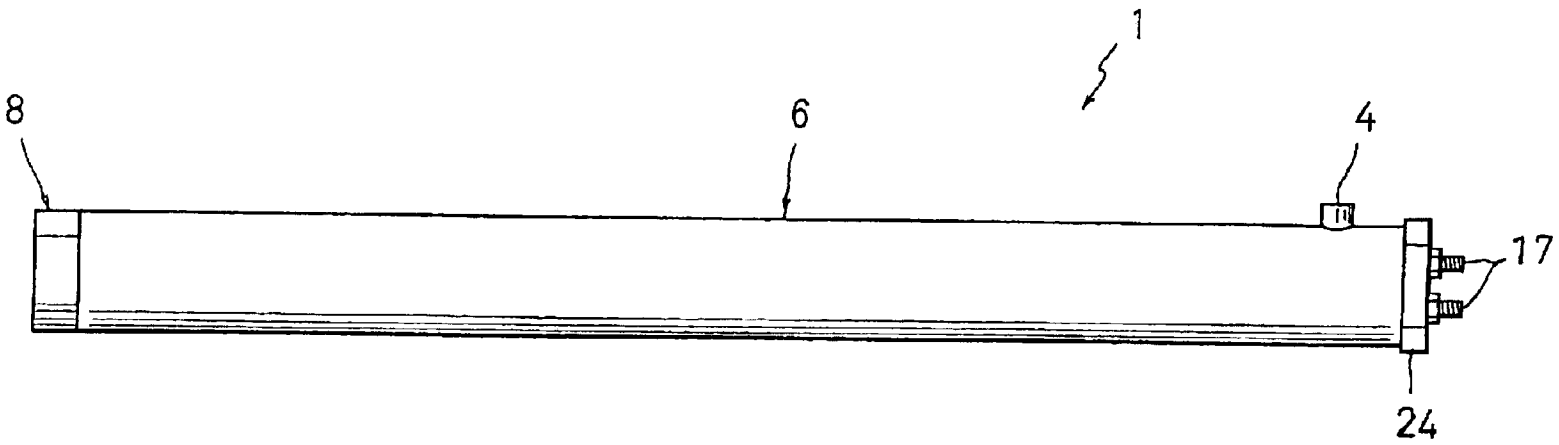
FIG. 2 is a side view of the embodiment of FIG. 1.
Figure 3:
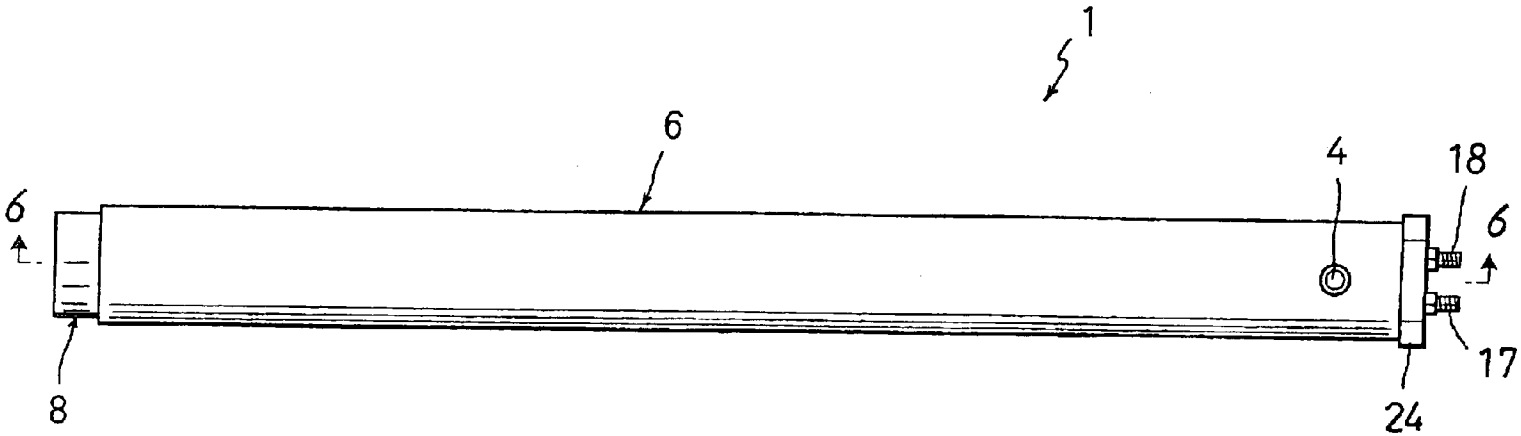
FIG. 3 is a top view of the embodiment of FIG. 1.
Figure 4:
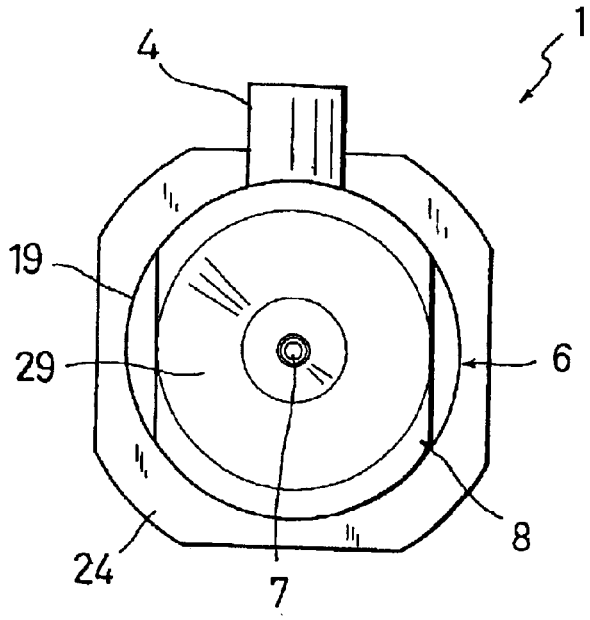
FIG. 4 is an expanded front view of the embodiment of FIG. 1.
Figure 5:
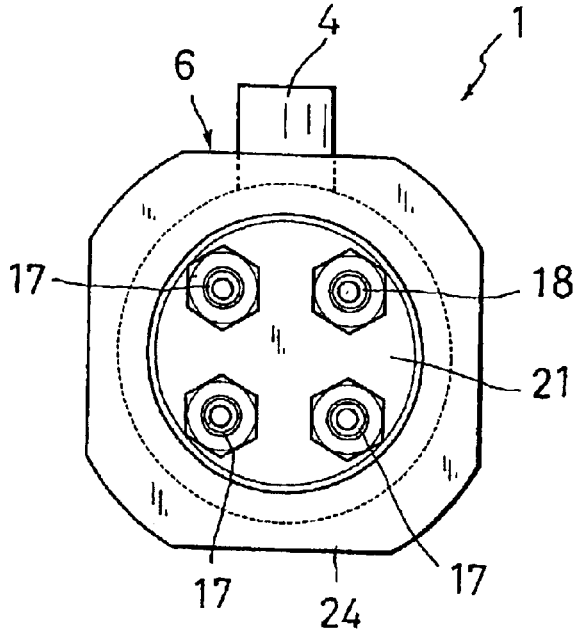
FIG. 5 is an expanded back view of the embodiment of FIG. 1.
Figure 6:
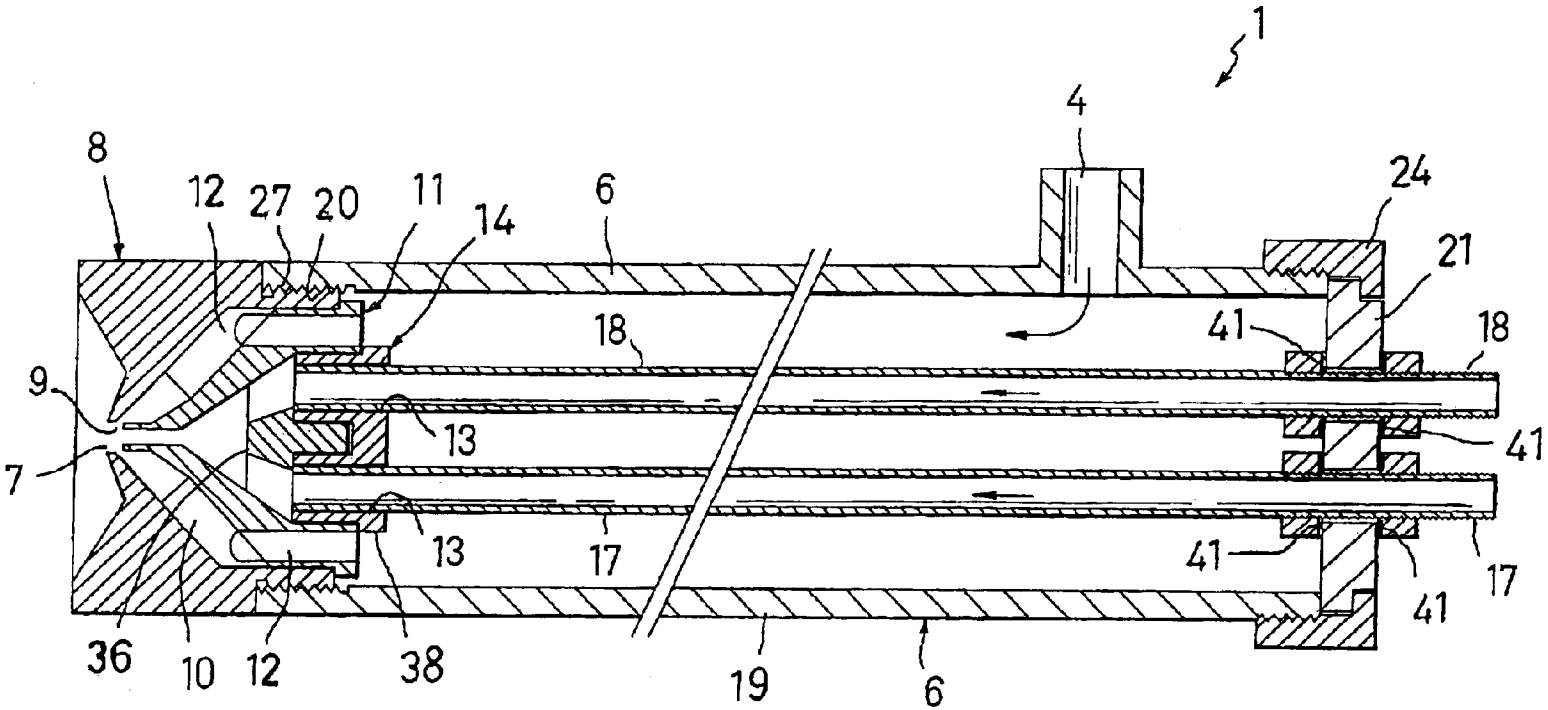
FIG. 6 is a cross sectional view of the embodiment of FIG. 1 taken along a line 6—6 of FIG. 2.

An understanding of the present invention may be best gained by reference to FIGS. 1 to 18. FIGS. 1 to 18 illustrate a first embodiment of the present invention wherein a combustion burner 1 is connected to an attachment 3 of the combustion burner 1 in a combustion furnace 2, such as, for example, a boiler.

The combustion burner 1 is composed of an air supply or plenum case 6, a nozzle body 8, an air nozzle 11, a plurality of air inlet holes 12, a fuel supply support member 14 and a plurality (e.g. four) fuel supply pipes 17,17,17,18. The air supply case 6 supplies air from air supply equipment 5 connected to an air supply mouth or inlet 4 formed at a portion of the air supply case 6, extending from adjacent a rear end of the air supply case 6 to a tip portion thereof. The nozzle body 8 is formed in the shape of a pipe, i.e., is cylindrical, having a jet nozzle 7 formed in a center part of the nozzle body 8. The fuel nozzle 11 is installed into the nozzle body 8. Air from the air supply case 6 flows through an air jet hole 9, positioned between a tip perimeter part of the fuel nozzle 11 and the jet nozzle 7. An air supply passage 10 is formed in the shape of a conical trapezoid. The air guide holes 12 are provided between an outer circumferential portion of the fuel nozzle 11 and the nozzle body 8 so as to supply air in a spiral or vortex pattern from the air jet hole 9. The fuel supply support member or header 14 is installed in the fuel supply passage 10 and supplies an opposite spiral air current from the tip end of the fuel nozzle 11 compared with the air current supplied from the air jet hole 9.

One end part of the fuel supply pipes 17 is connected to four fuel supply holes 13,13,13,13 respectively. Another end part thereof is connected to the fuel supply 15 which supplies waste oil, heavy oil and the like and water supply 16 which supplies water, dirty water and the like, projecting outwardly from the part adjacent the rear end part of the air supply case 6.

Figure 7:
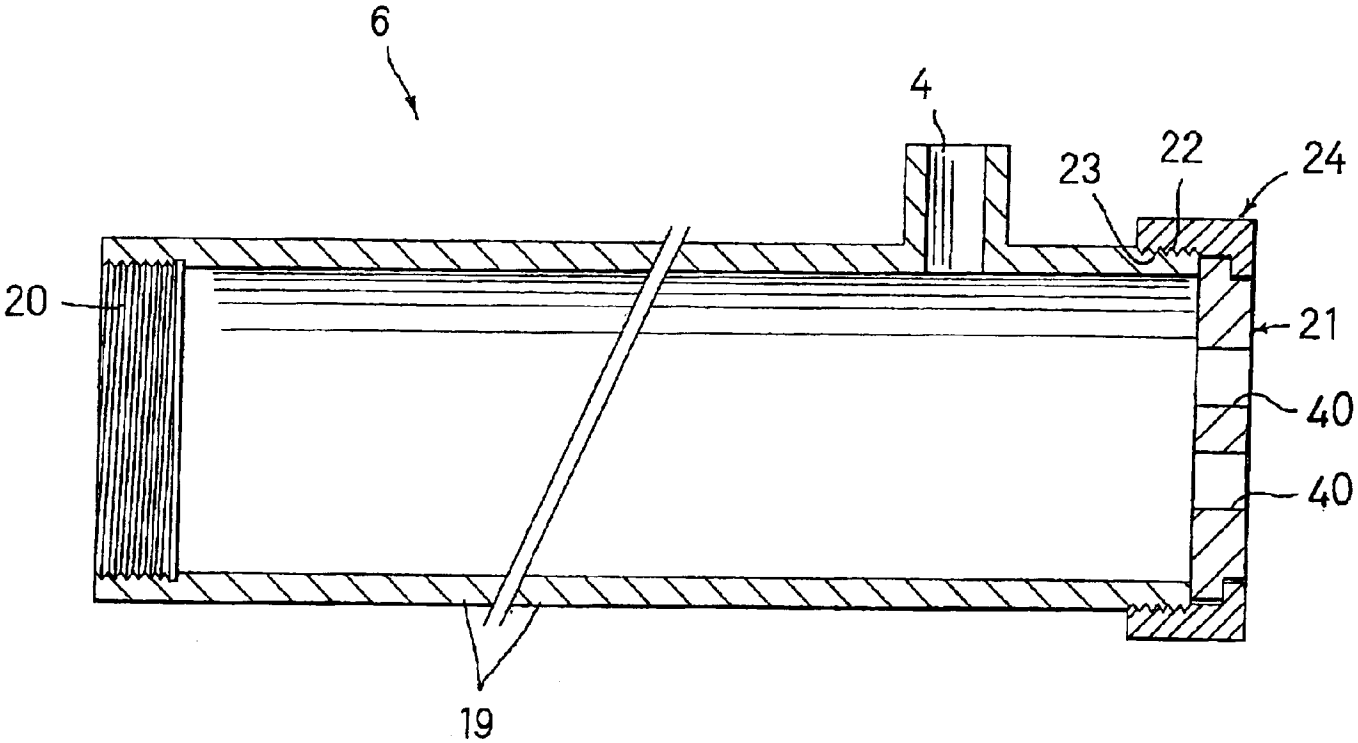
FIG. 7 is an explanation view of an air supply case.

As shown in FIG. 7, the air supply case 6 includes an air supply case body 19 formed in the shape of a pipe. A screw part 20 is formed at the inner wall at the tip portion of the air supply case body 19. The air supply mouth 4 is formed at a portion adjacent the rear end part of the air supply case body 19. A blockade plate 21 covers the rear end part of the air supply case body 19. A ring 24, a fixed to the blockade plate, includes a thread portion 23 which is screwed onto a thread portion 22 formed at the outer circumferential portion of the rear end of the air supply case body 19, capable of fixing the blockade plate 21.

The air supply 5 consists of a blower 25 and an air supply hose 26 which connects to the air supply mouth 4 of the air supply case 6 so as to supply air from the blower 25.

Figure 8:
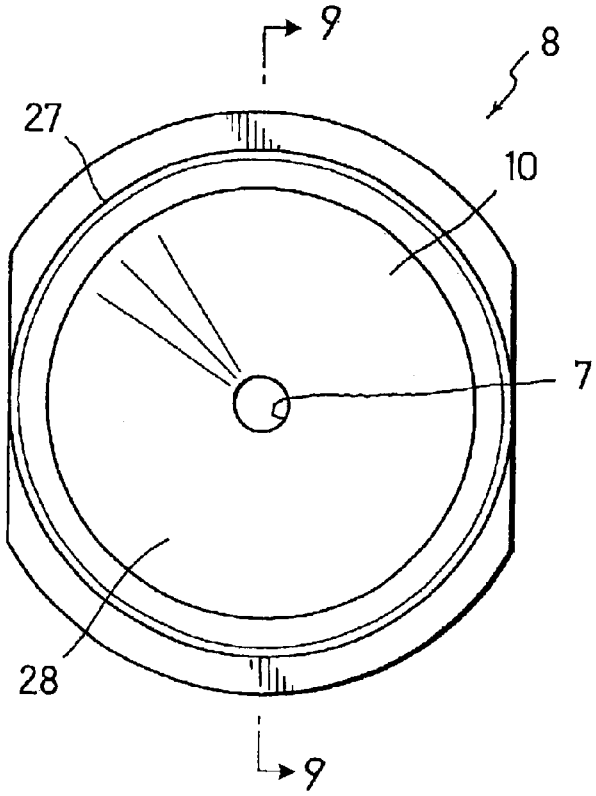
FIG. 8 is a front view of a nozzle body for a combustion burner according to the present invention.
Figure 9:
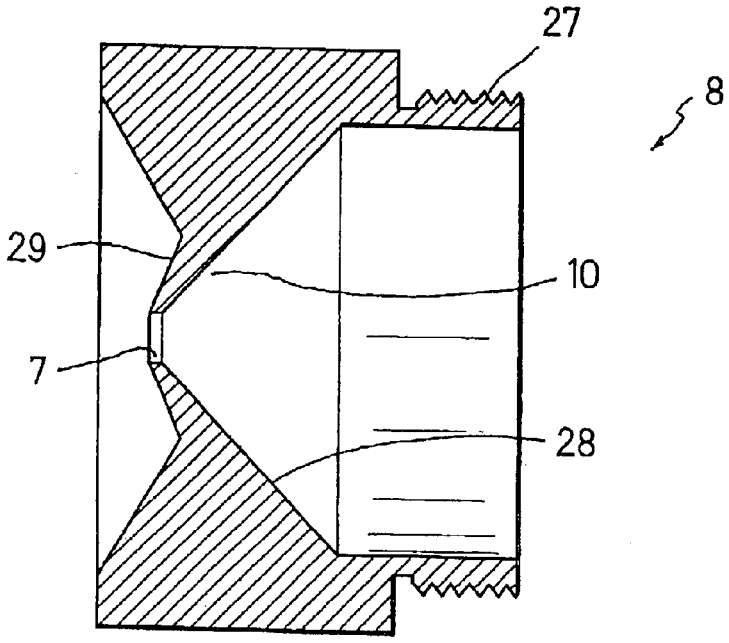
FIG. 9 is a cross sectional view of the nozzle body of FIG. 8, taken along a line 9—9 of FIG. 8.
Figure 10:
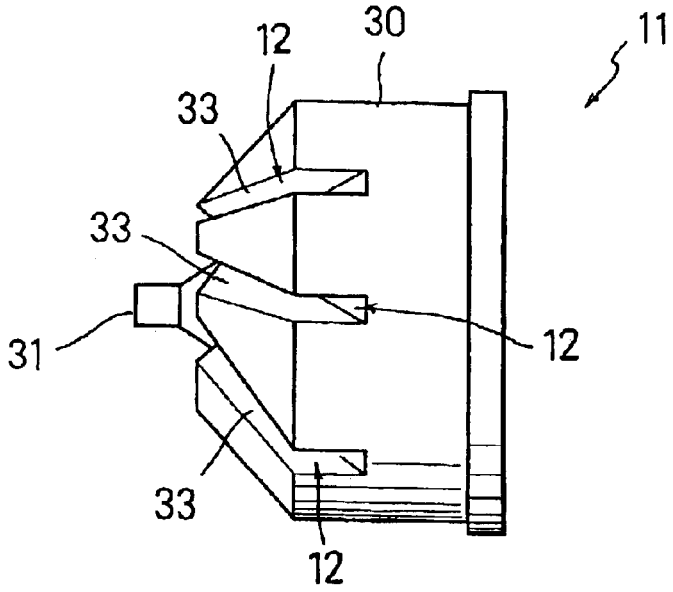
FIG. 10 is a side view of a fuel nozzle for a combustion burner according to the present invention.
Figure 11:
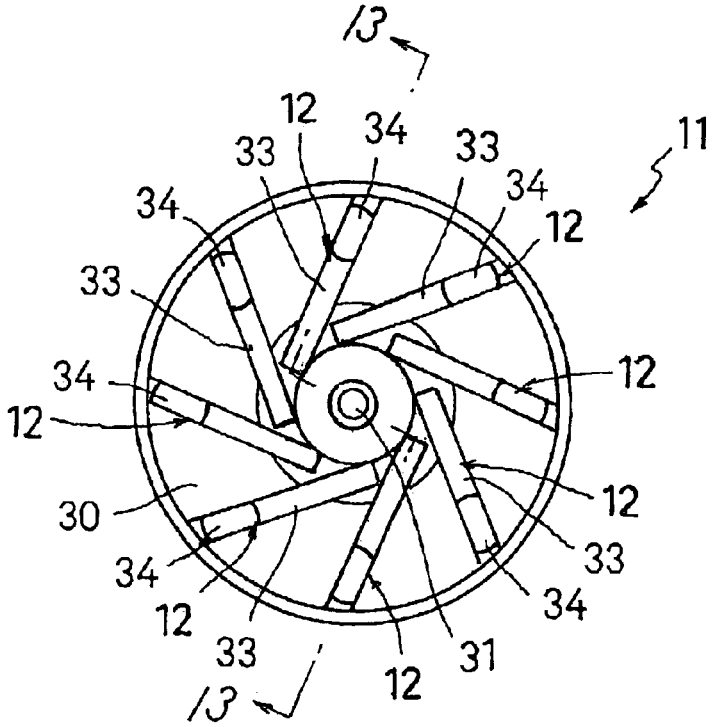
FIG. 11 is a front view of the fuel nozzle of FIG. 10.
Figure 12:
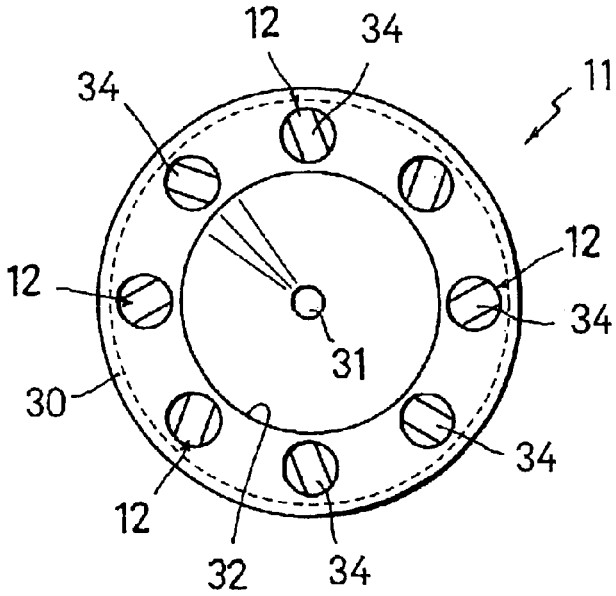
FIG. 12 is a back view of the fuel nozzle of FIG. 10.
Figure 13:
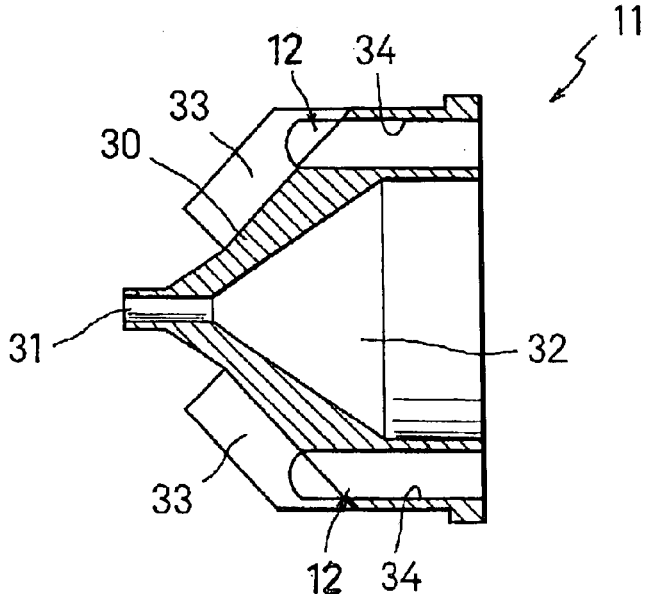
FIG. 13 is a cross sectional view of the fuel nozzle of FIG. 10, taken along a line 13—13 of FIG. 11.
Figure 14:
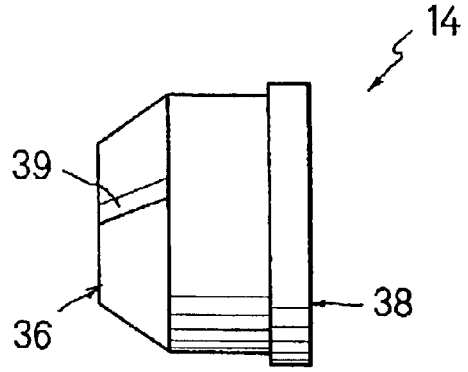
FIG. 14 is a side view of a fuel supply support member for a combustion burner according to the present invention.
Figure 15:
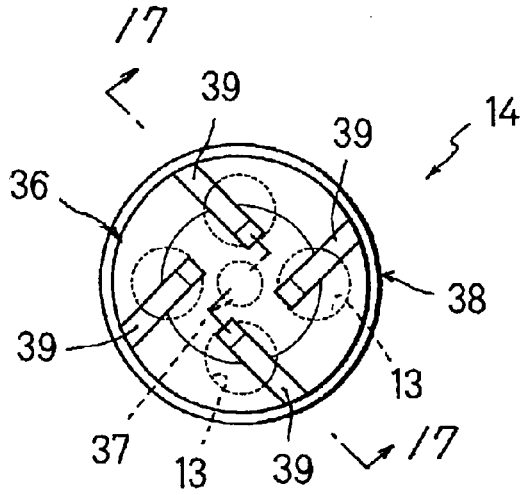
FIG. 15 is a front view of the fuel supply support member of FIG. 14.
Figure 16:
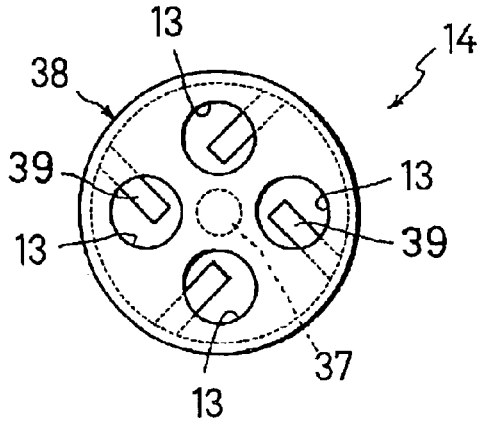
FIG. 16 is a back view of the fuel supply support member of FIG. 14.
Figure 17:
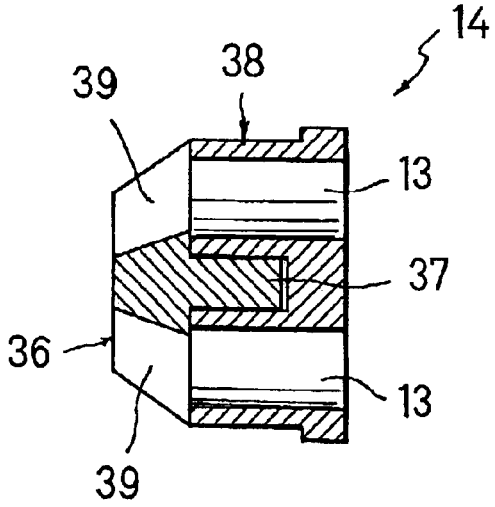
FIG. 17 is a cross sectional view of the final supply support member of FIG. 14, taken along a line 17—17 of FIG. 15.
Figure 18:
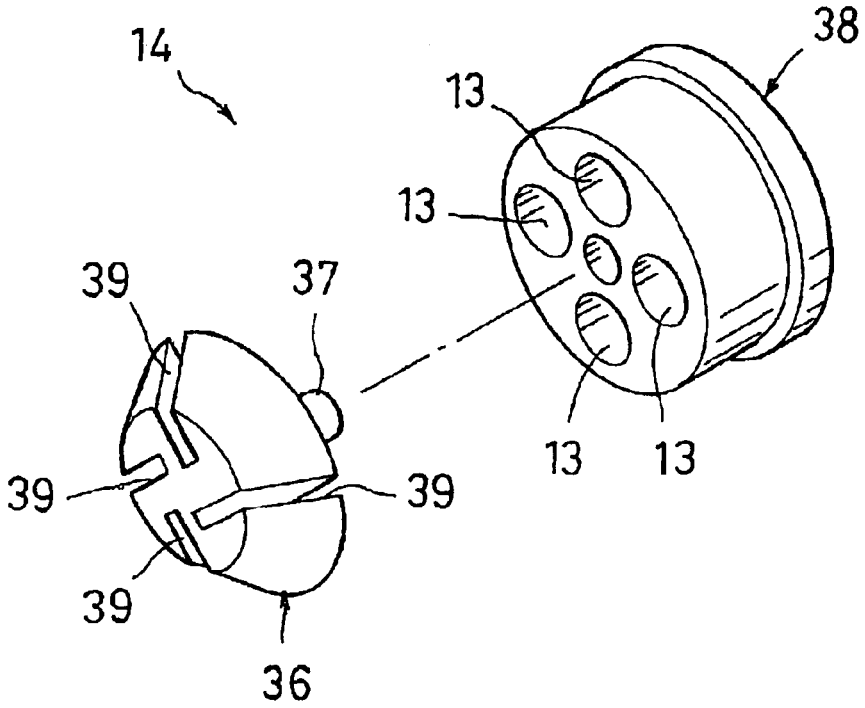
FIG. 18 is an exploded view of the fuel supply support member of FIG. 14.
Figure 19:
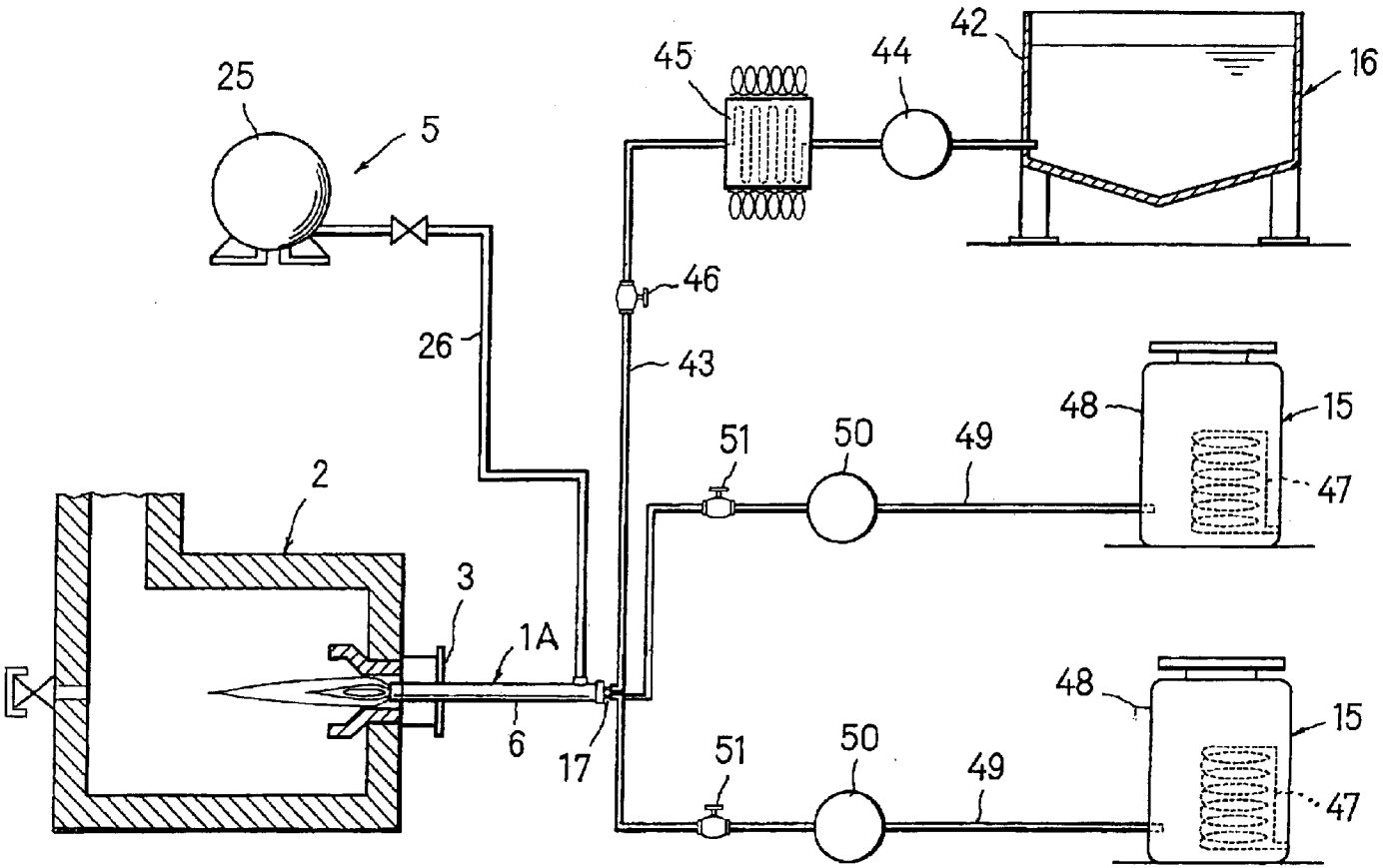
FIG. 19 is an overall view of a second embodiment of a combustion burner and system according to the present invention.
Figure 20:
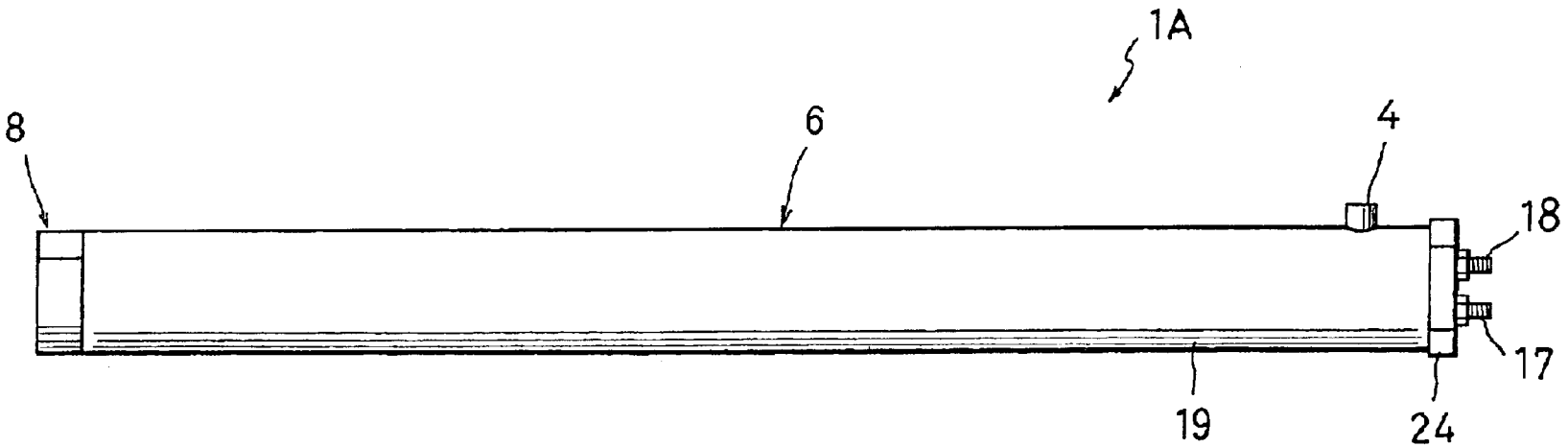
FIG. 20 is a side view of the embodiment of FIG. 19.
Figure 21:
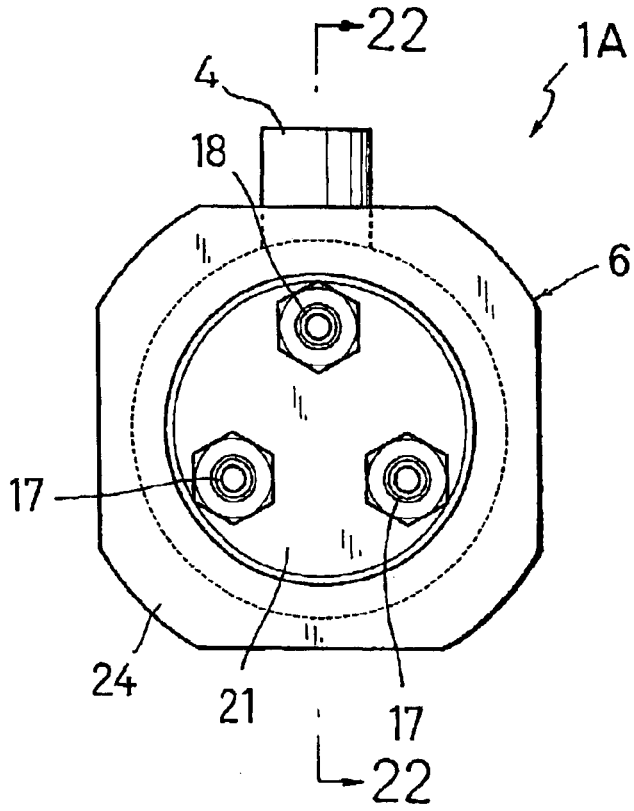
FIG. 21 is an expanded back view of the embodiment of FIG. 19.
Figure 22:
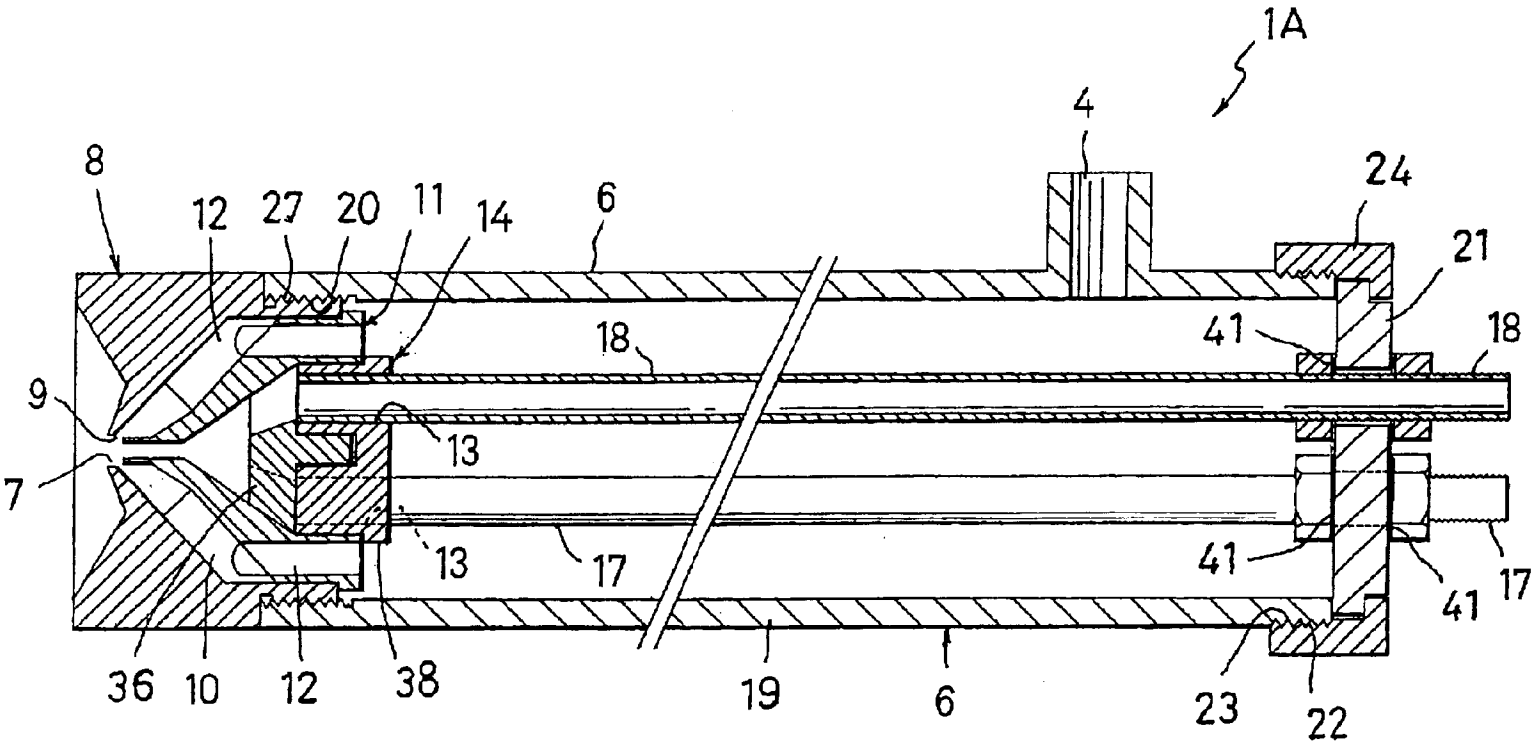
FIG. 22 is a cross sectional view of the embodiment of FIG. 19, taken along a line 22—22 of FIG. 21.
Figure 23:
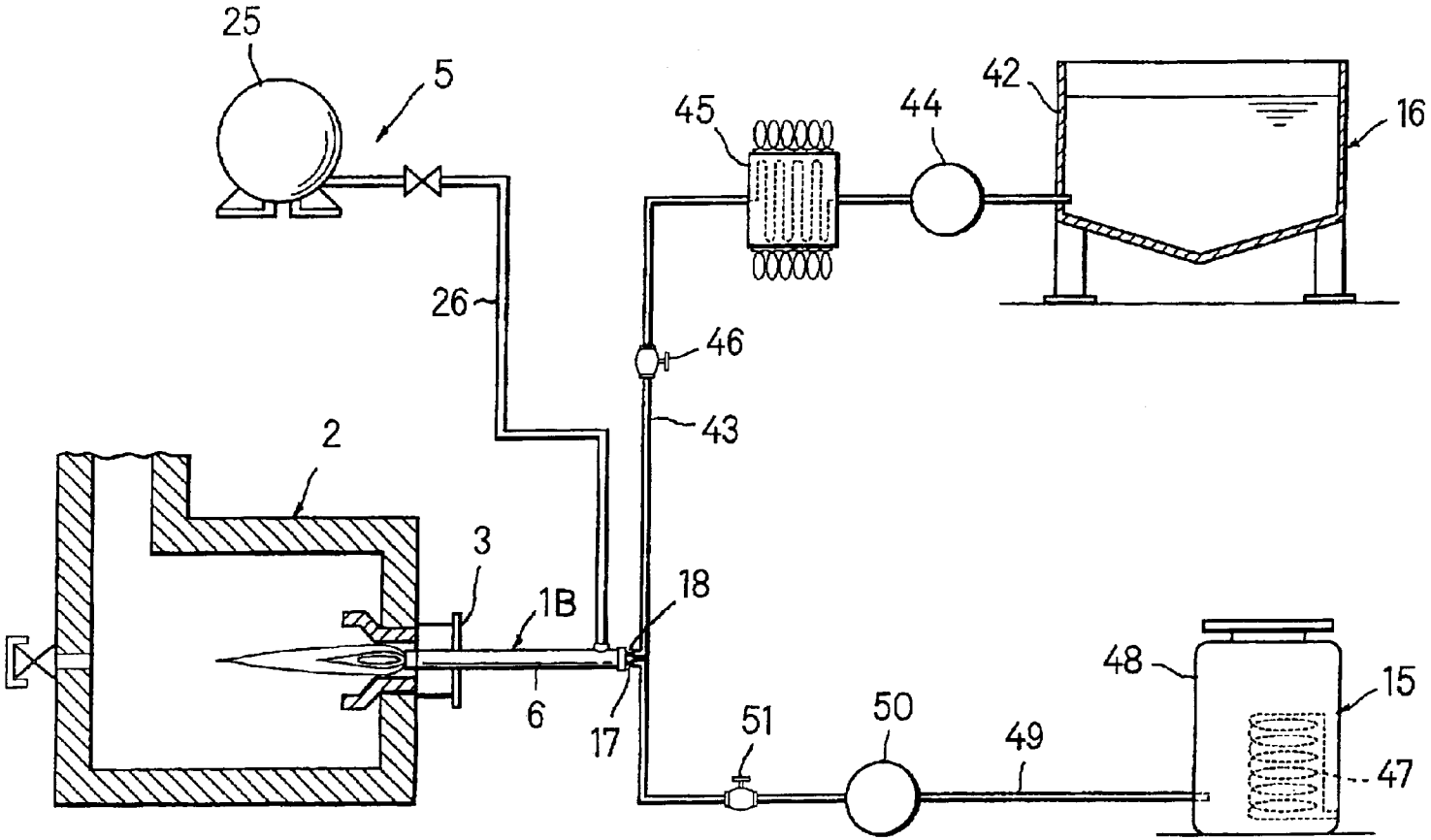
FIG. 23 is an overall view of a third embodiment of a combustion burner and system according to the present invention.
Figure 24:
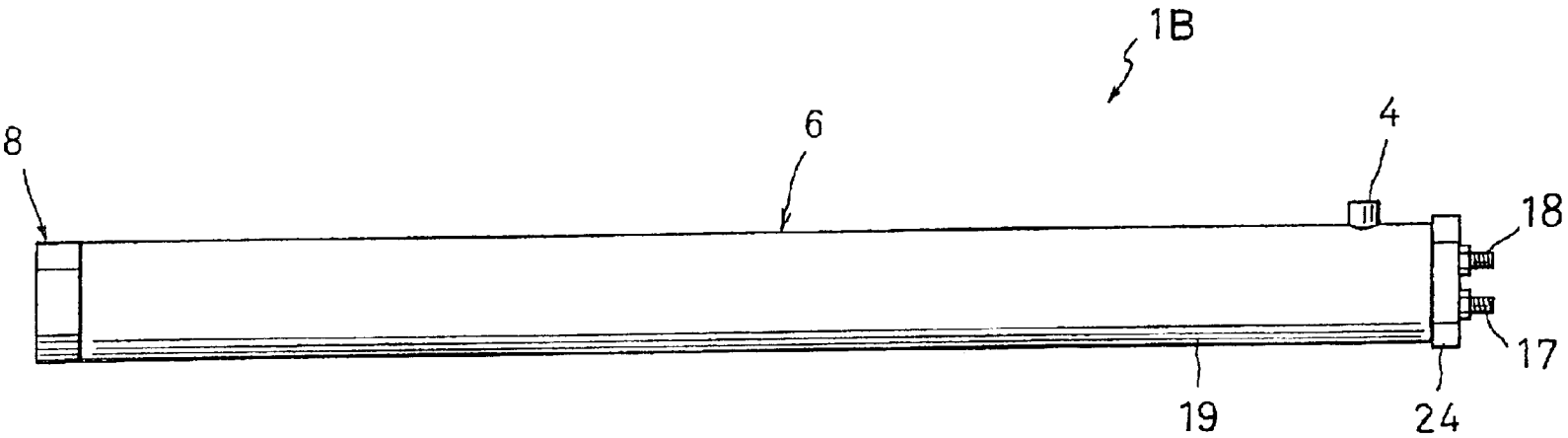
FIG. 24 is a side view of the embodiment of FIG. 23.
Figure 25:
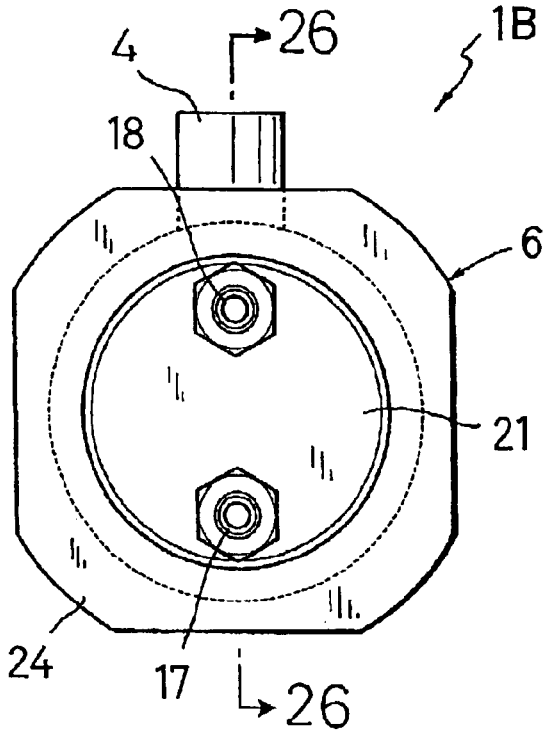
FIG. 25 is an expanded back view of the embodiment of FIG. 23.
Figure 26:
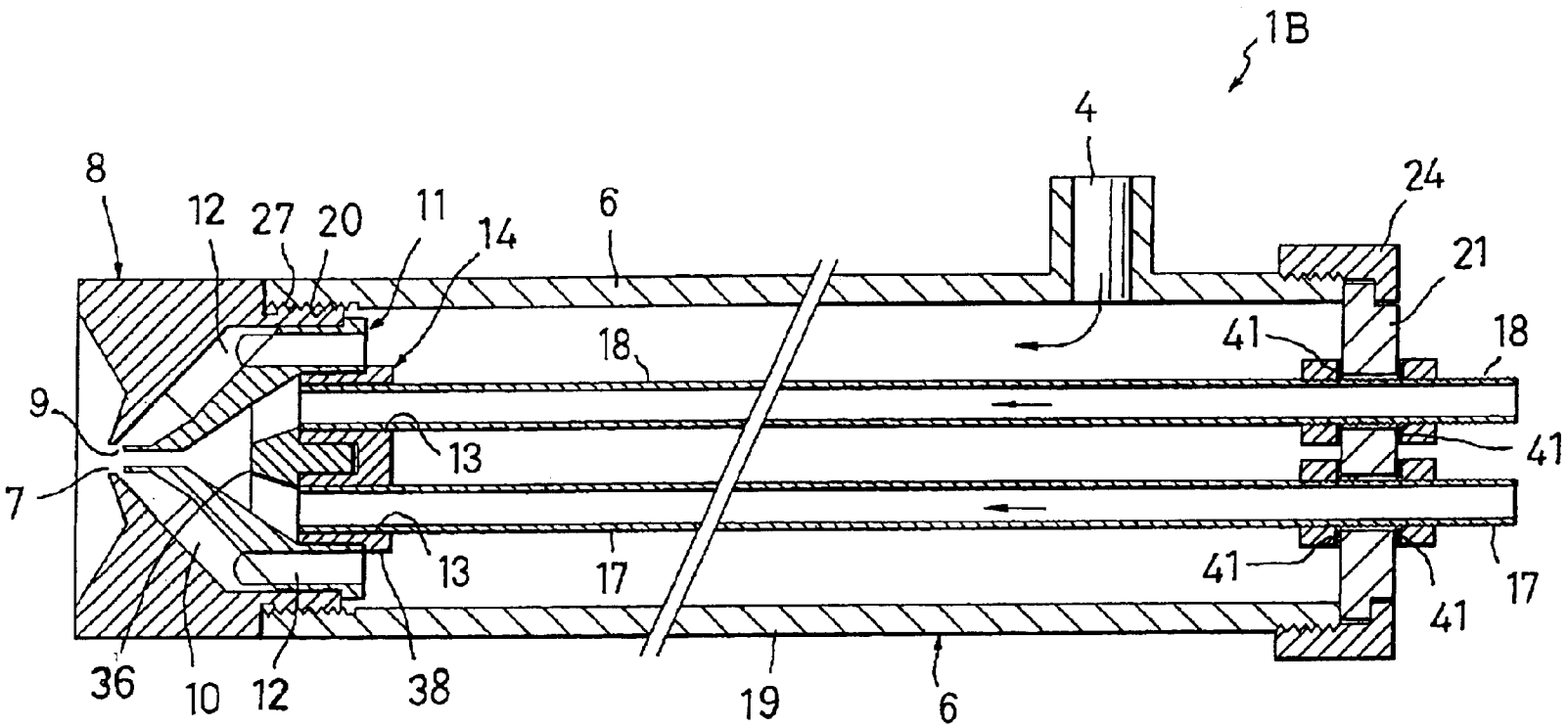
FIG. 26 is a cross sectional view of the embodiment of FIG. 25, taken along a line 26—26 of FIG. 25.
Figure 27:
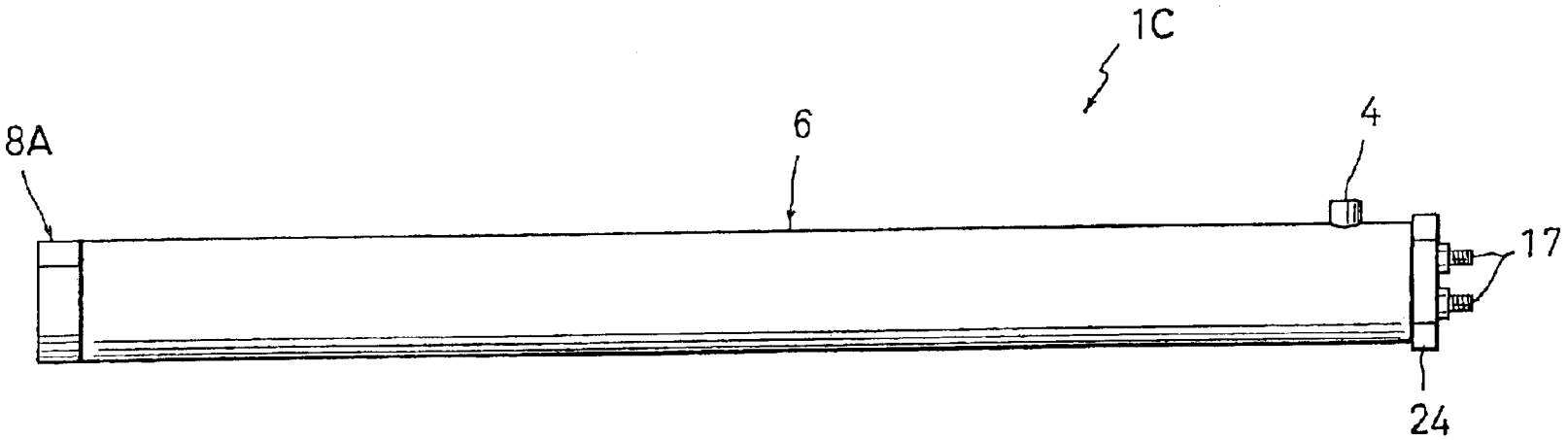
FIG. 27 is a side view of a fourth embodiment of a combustion burner according to the present invention.
Figure 28:
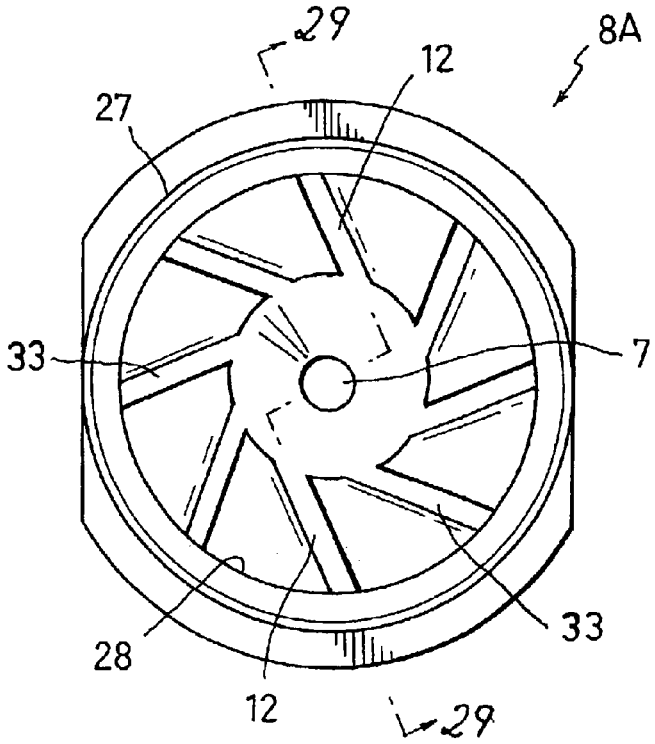
FIG. 28 is a back view of a nozzle body of said fourth embodiment of FIG. 27.
Figure 29:
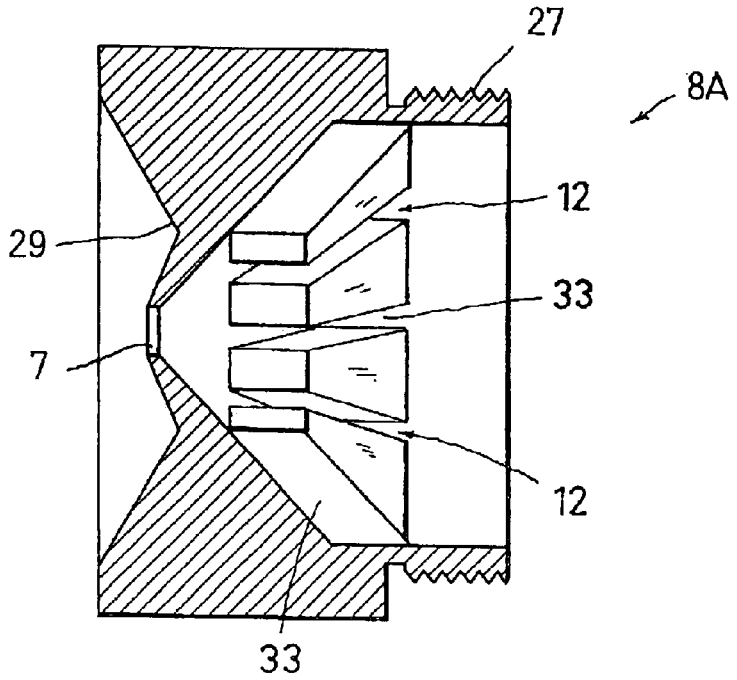
FIG. 29 is a cross sectional view of the nozzle body of FIG. 28, taken along a line 29—29 of FIG. 28.
Figure 30:
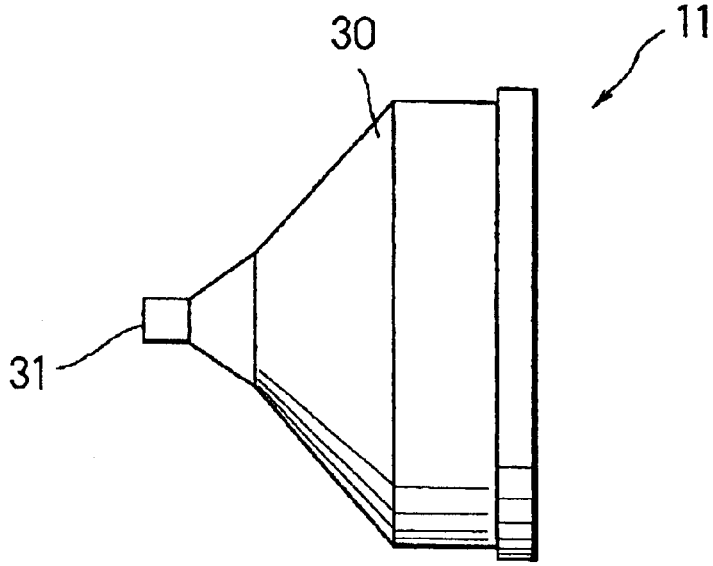
FIG. 30 is a side view of a fuel nozzle.
Figure 31:
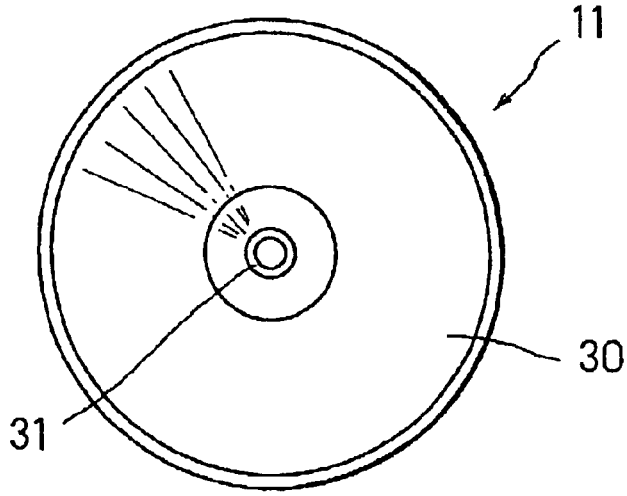
FIG. 31 is a front view of a fuel nozzle.
Figure 32:
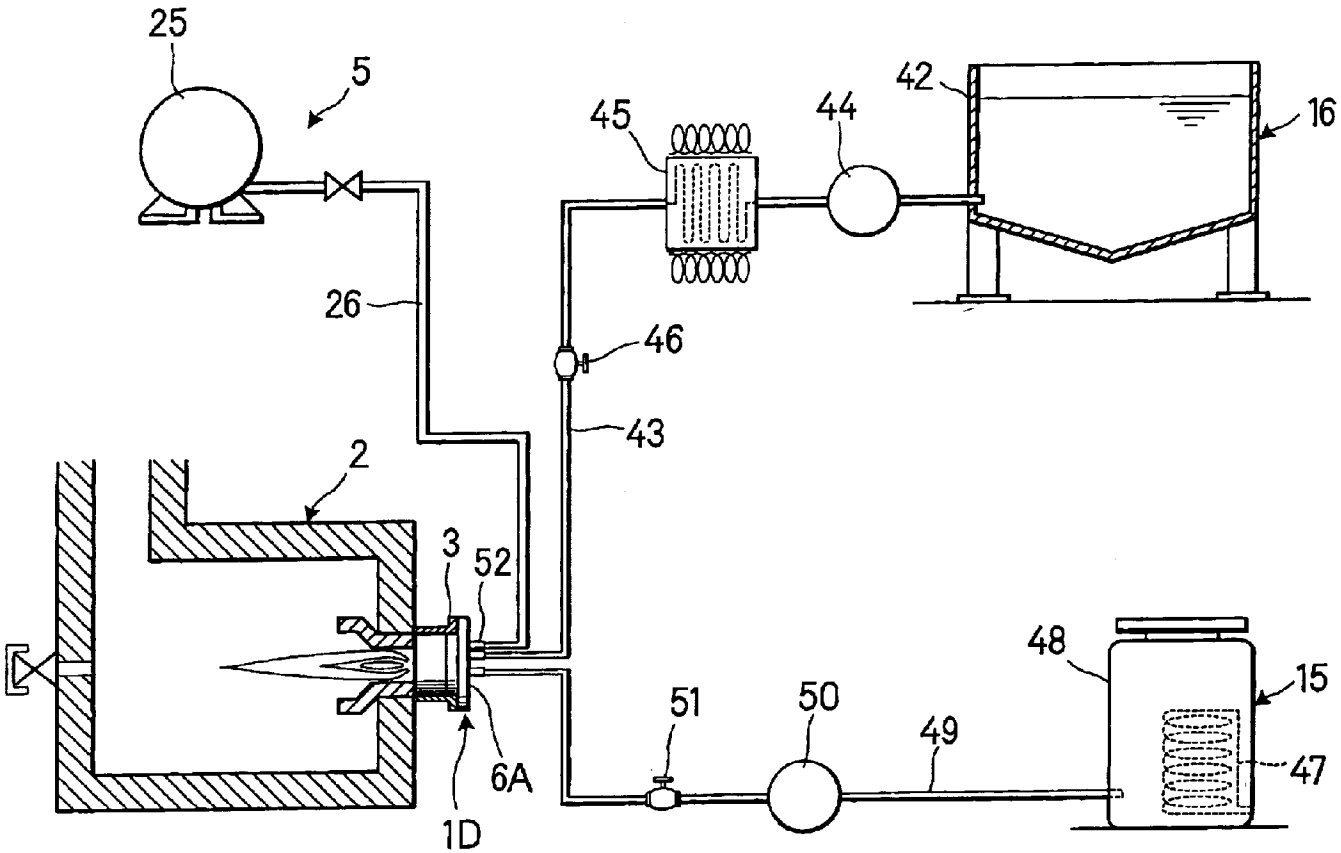
FIG. 32 is an overall view showing a fifth embodiment of a combustion burner and system according to the present invention.
Figure 33:
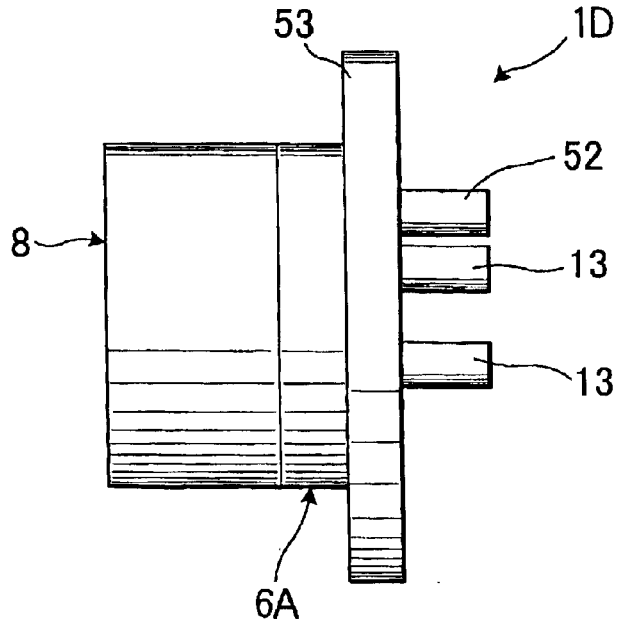
FIG. 33 is a side view of the embodiment of FIG. 32.
Figure 34:
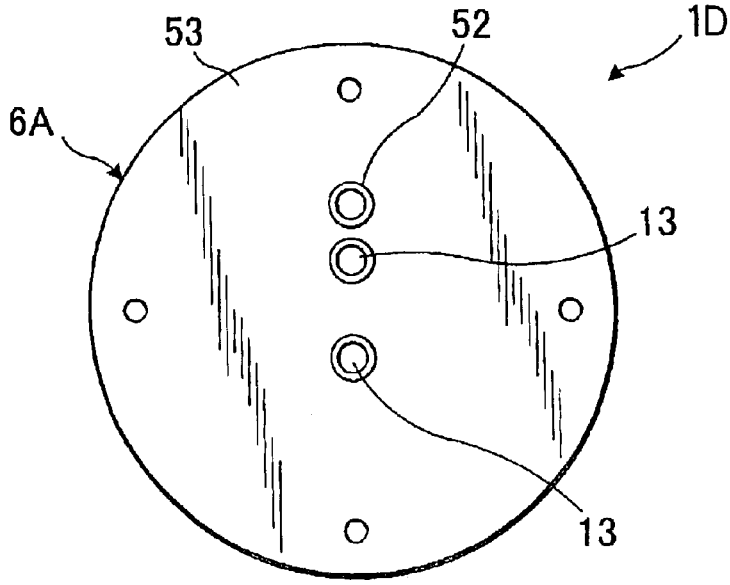
FIG. 34 is a back view of the embodiment of FIG. 32.
Figure 35:
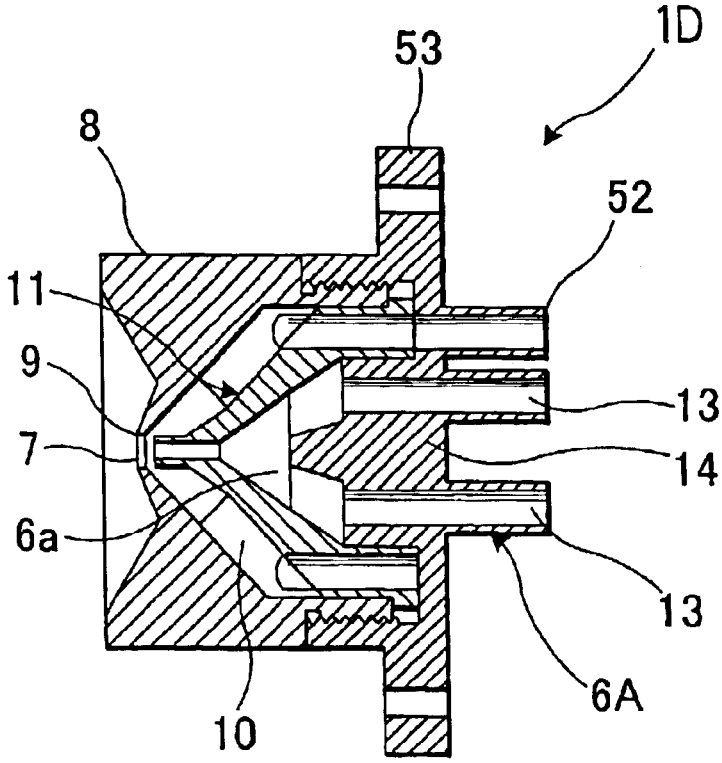
FIG. 35 is a cross sectional view of the embodiment of FIG. 32, taken along a line 35—35 of FIG. 34.

As shown in FIGS. 8 and 9, the nozzle body 8 is formed from metal material, such as, for example, heat-resistant and acid-proof stainless steel. The nozzle body 8 includes a thread part 27 formed at the outer circumferential part of the rear end part thereof and which is screwed onto the screw part 20 provided at the tip end portion of the air supply case body 19. A tip part thereof forms an arc-shaped concave portion 28 in the rear portion thereof, installing the fuel nozzle as the fuel supply passage 10. The jet hole 7 is formed at the central part of the concave portion 28, a jet concave part 29 is formed in a W-shape provided at the tip end portion thereof.

As shown in FIGS. 10 to 13, the fuel nozzle 11 is composed of a fuel nozzle body 30 installed into the concave portion 28 of the nozzle body 8 and formed in the shape of a conical trapezoid. A nozzle mouth 31 projects from the central portion at the front of the fuel nozzle body 30 and is formed so as to jet air through the jet hole 7 of the nozzle body 8. A concave portion 32 installed adjacent the fuel supply support member 14 is formed in the shape of a conical trapezoid and formed at the fuel nozzle body 30 so as to connect thereinto. The air guide holes 12 include a plurality of air guide grooves 33 and air holes 34. The air guide grooves 33 which supply air in a spiral or vortex pattern are provided at the tip portion adjacent the nozzle mouth 31 of the fuel nozzle body 30, and the air hole 34 which opens to the direction of the air supply case 6 connects to the air guide groove 33.

As shown in FIGS. 14 to 18, the supply support member 14 includes a fuel guide member 36, a fuel supply pipe support member 38, four fuel guide grooves 39 and fuel supply holes 13,13,13,13. The fuel guide member 36 which is formed in the shape of a conical trapezoid supplies an opposite spiral air current compared with the air current supplied from the air jet hole 9. The fuel supply pipe support member 38 is formed in the shape of a pillar and inserted fixedly a support 37 provided at the central part of the rear end of the fuel guide member 36. The fuel supply holes 13 are connected to the fuel guide grooves 39 respectively and inserted one end portion of the fuel supply pipes 17,17,17,18 thereinto respectively.

Another end of the fuel supply pipes is provided so as to pass through through-holes 40 provided at the blockade plate 21 of the air supply case 6. Sealing members 41,41, 41,41 fill the portions between the through-holes 40,40,40, 40 and the fuel supply pipes 17,17,17,18 leading thereinto, respectively, so as to prevent air leakage.

The water supply 16 includes a water supply hose or line 43 which directs the water from a tank or a pollution tub 42 to the fuel supply pipe 18; a pump 44 is interposed between the water supply hose 43; a heater 45 which heats water to about 70 degrees C.; and an opening-and-closing valve 46.

The fuel supply 15,15,15 includes a plurality (3 being shown in FIG. 1) of fuel tanks 48,48,48 with 47,47,47 which heat fuel, such as, waste oil, heavy oil at about 70 degrees C.; a corresponding plurality of fuel supply lines 49,49,49 which direct the fuel from the fuel tanks 48 to the fuel supply pipes 17; a corresponding plurality of pumps 50,50,50 and a corresponding plurality of opening-and-closing valves 51,51,51 interposed between the fuel supply lines 49,49,49.

In the combustion burner 1, the air supplied from the air supply equipment 5 is introduced to the air guide groove 33 from the air hole 34 from the inside of the air supply case 6 and is jetted in a spiral pattern from the air jet hole 9.

Water, dirty water and the like,supplied from the water supply equipment 16, passes through the fuel supply pipe 18 and the fuel guide groove 39; and fuel including waste oil, heavy oil and the like, supplied from the fuel supply equipment 16, passes through the fuel supply pipes 17,17,17 and the fuel guide grooves 39,39,39. Then, water, fuel and the like are sucked and jetted in a opposite spiral pattern compared with the air spiral pattern.

Water, dirty water, waste oil, and the like are mixed with air in a spiral pattern at the opposite spiral pattern and mixed, in an atomized mixture state having a droplet size of about 5 to 10 microns for efficient combustion. Moreover, in this embodiment, water, dirty water, waste oil, heavy oil and the like supply into the fuel supply pipes 17,17,17,18, however, fuel gas may be supplied into one of the fuel supply pipes 17,17,17,18.

In addition, at least two objects including water, dirty water, waste oil, heavy oil, odorous gas, gas and the like may be selected and supplied into the fuel supply pipe.

Other embodiments of the present invention will now be described with reference to FIGS. 19–35. In FIGS. 19–35, the same components as in the first embodiment described above with reference to FIGS. 19–35 are designated by the same reference numerals and therefore will not be further explained in great detail.

A second embodiment of the present invention is shown in FIGS. 19 to 22. It is distinguished from the first embodiment in that one water supply pipe 18 and two fuel supply pipes 17,17 are used. A combustion burner IA according to the second embodiment has similar advantages to that according to the first embodiment.

A third embodiment of the present invention is shown in FIGS. 23 to 26. It is distinguished from the first embodiment in that one water supply pipe 18 and one fuel supply pipe 17 are used. A combustion burner 1B according to the third embodiment has similar advantages to that according to the first embodiment. A fourth embodiment of the present invention is shown in FIGS. 27 to 31. It is distinguished from the first embodiment in that the air guide holes 12 having the air guide grooves 33 are provided at the concave portion 28 of nozzle body 8A. A combustion burner 1C with the air guide holes 12 according to the fourth embodiment has similar advantages to that according to the first embodiment.

A fifth embodiment of the present invention is shown in FIGS. 32 to 35. It is distinguished from the third embodiment in that an air supply case 6A is formed in the shape of a cap, having a pipe 52 which supplies air from the air supply equipment 5; the nozzle body 8 is attached so as to cover an opening 6*a* of the air supply case 6A and is formed in the shape of a pipe, having a concave portion as a jet nozzle 7 formed in a center part of the nozzle body 8; the supply support member 14 is installed into the air supply case 6A so as to be positioned at the inside of the fuel supply passage 10 and to supply fuel from at least two fuel supply holes, according to this embodiment, from the fuel nozzle 11 in an opposite spiral pattern; and a flange 53 is provided at an outer circumferential portion of the air supply case 6A and is attached to the wall or the like. A combustion burner 1D according to the fifth embodiment has similar advantages to that according to the third embodiment, and the air supply case formed in the shape of a pipe is not used so that the apparatus of this embodiment is even more compact and has a small size.

As set forth above, the advantages of the invention are as follows:

(1) A combustion burner includes an air supply case connected to an air supply mouth formed at one of a portion adjacent a rear end thereof and rear end part to a tip portion thereof and formed in the shape of a pipe, supplying air from an air supply equipment; a nozzle body formed in the shape of a pipe and attached so as to cover a tip portion of the air supply case, having a jet nozzle formed in a center part of the nozzle body; a fuel nozzle installed into the nozzle body so as to supply air from the air supply case from the air jet hole, placed between the tip perimeter part of the fuel nozzle and the jet hole, having a fuel supply passage which is formed in the shape of a conical trapezoid and supplies air from a tip portion thereof; a plurality of air guide holes air guide holes provided between an outer circumferential portion of the fuel nozzle and the nozzle body so as to supply spiral air from the air jet hole; a fuel supply support member installed into the fuel supply passage and supplies fuel from at least two fuel supply holes at an opposite spiral air current from the tip end of the fuel nozzle compared with the air current supplied from the air jet hole; and at least two fuel supply pipes, one end part of the fuel supply pipes connected to the fuel supply holes, another end part thereof connected to a fuel supply which supplies waste oil, heavy oil and the like and water supply which supplies water, dirty water and the like, projecting outwardly from the part adjacent the rear end part of the air supply case so that water, air, and oil including waste oil, heavy oil and so on are mixed, and it can be supplied into the nozzle.

Therefore, mixed fuel can be made to burn efficiently.

(2) As discussed above, since water, dirty water, waste oil, heavy oil and the like are mixed at a top part of the nozzle, it is not necessary to use an expensive churning mixer using an emulsifier as heretofore required, and can be practiced at low cost.

(3) As discussed above, since water is added to fuel including waste oil, heavy oil and the like, it can be burned in the state where it can efficiently prevent generation of nitrogen oxide.

(4) As discussed above, the conventionally unsuitable fuel for combustion such as C heavy oil, waste oil and so on can be used as fuel.

What is claimed is:

1. Combustion burner comprising:

an air supply plenum, having a cylindrical shape with a front tip end and a rear end, and an elongate hollow section therebetween;

an air supply inlet, on said air supply plenum, between its said front tip end and its said rear end, and in fluid communication therewith;

a cylindrical nozzle body, attached to and in fluid communication with, said front tip end of said air supply plenum;

an outlet jet hole, in said nozzle body;

an air nozzle, having an elongate, hollow cylindrical shape, with a frustoconical front end, and a flat planar rear end, said air nozzle being in said front tip end of said air supply plenum, towards an outer periphery thereof, coaxially oriented with a longitudinal axis of said air supply plenum, and extending into said cylindrical nozzle body, for supplying air from said air supply plenum to said jet hole in said cylindrical nozzle body;

a plurality of air guides in each of said at least one air nozzle, each said air guide comprising:

an air inlet hole in a rear end of said frusto-conical front end of each of said at least one air nozzle, for accepting an air stream from said air supply plenum, such that an opening of said air inlet hole is oriented coaxially with a longitudinal axis of said air nozzle, and is positioned towards an outer periphery of said air guide adjacent to said air nozzle; and a corresponding air guide channel, in fluid communication with said air inlet hole, such that said air guide channel is transverse to said longitudinal axis of said air nozzle, so as to change a direction of flow of air flowing into said air inlet hole to a direction perpendicular to said longitudinal axis of said air nozzle, such that a stream of air exits from each air guide channel in a spiral vortex pattern;

a fuel supply header, centrally positioned in said front tip end of said air supply plenum, extending into said cylindrical nozzle body, at a central part thereof, concentric with said air nozzle, and having a frusto-conical front end, a circurlarly planar rear end, and a hollow cylindrically shaped elongated portion therebetween;

a plurality of fuel supply inlet pipes, centrally positioned in said air supply plenum, extending longitudinally through said rear end thereof, towards said front tip end thereof, for delivering at least one of a combustible fuel and additives thereto to said combustion burner;

a plurality of fuel supply inlet holes in said planar rear end of said fuel supply header, for accepting front ends of said plurality of fuel supply inlet pipes, and in fluid communication therewith;

a plurality of fuel guide grooves, corresponding in number to a number of said plurality of fuel supply inlet holes, in said frusto-conical front end of said fuel supply header, open at at least one direction of coaxial with a longitudinal axis of said fuel supply pipes and transverse thereto, for distributing said at least one of said combustible fuel and said additives thereto from said fuel supply header in a spiral vortex pattern of opposite direction to said spiral vortex pattern of said air exiting from said air outlet nozzle.

2. Combustion burner according to claim 1, wherein there are four said fuel supply inlet pipes.

3. Combustion burner according to claim 2, wherein three said fuel supply inlet pipes are for delivery of combustible fuel and one said fuel supply inlet pipe is for delivery of an additive to said combustible fuel.

4. Combustion burner according to claim 1, wherein there are three said fuel supply inlet said pipes.

5. Combustion burner according to claim 4, wherein two fuel supply inlet pipes are for delivery of combustible fuel and one said fuel supply inlet pipe is for delivery of an additive to said combustible fuel.

6. Combustion burner according to claim 1, wherein there are two said fuel supply inlet pipes.

7. Combustion burner according to claim 6, wherein one said fuel supply inlet pipe is for delivery of combustible fuel and one said fuel supply inlet pipe is for delivery of an additive to said combustible fuel.

8. Combustion burner according to claim 1, wherein said combustible fuel is selected from the group consisting of: type C oil; heavy oil; and waste oil.

9. Combustion burner according to claim 1, wherein said fuel additive is water.

10. Combustion burner according to claim 1, wherein there are from 2 to 8 air guides.

11. Combustion burner according to claim 1, further comprising a seal in said rear end of said air supply plenum at each said fuel supply inlet pipe, to prevent air leakage from said air supply plenum.

12. Combustion burner system comprising:

a combustion burner according to claim 1;

an air supply source;

an air supply line;

an air blower, for blowing air from said air supply source through said air supply line into said air supply plenum through said air supply inlet thereof;

at least one fuel storage tank, for storing said combustible fuel;

at least one fuel heater, for heating said combustible fuel;

at least one fuel delivery line for transferring said combustible fuel from said fuel storage tank;

at least one fuel valve, for regulating flow of said combustion fuel from said fuel tank to said combustion burner; and at least one fuel pump for pumping said combustible fuel from said fuel storage tank through said fuel delivery line to said at least one fuel supply inlet pipe of said combustion burner.

13. Combustion burner system according to claim 12, further comprising:

a fuel additive storage tank;

a fuel additive pump;

a fuel additive delivery line; and a fuel additive heater.

14. Combustion burner system according to claim 12, wherein there are a plurality of fuel storage tanks and a corresponding plurality of each of said fuel delivery lines and said fuel pumps.

15. Combustion burner system according to claim 14, wherein there are a corresponding plurality of fuel heaters.

16. Combustion burner system according to claim 15, wherein there is a fuel heater in each fuel storage tank.

17. Combustion burner system according to claim 14, wherein there is a single fuel heater heating fuel from all fuel storage tanks while in corresponding said fuel supply inlet pipes, prior to entry into said air supply plenum.

* * * * *